United States Patent [19]

Weinmann

[11] 3,995,375

[45] Dec. 7, 1976

[54] DISCHARGE AND DRAW-OFF DEVICE FOR DRIERS OF MATERIAL WEBS

[75] Inventor: Alfred Weinmann, Graz, Austria

[73] Assignee: Maschinenfabrik Andritz Aktiengesellschaft, Austria

[22] Filed: Sept. 24, 1973

[21] Appl. No.: 399,966

[30] Foreign Application Priority Data

Oct. 31, 1972 Austria ..... 9247/72

[52] U.S. Cl. ..... 34/155

[51] Int. Cl.[2] ..... F26B 13/00

[58] Field of Search ..... 34/155, 156, 157, 158, 34/159

[56] References Cited

UNITED STATES PATENTS

| | | | |
|---|---|---|---|
| 3,292,274 | 12/1966 | Seth | 34/155 |
| 3,577,651 | 5/1971 | Nichols | 34/155 |

FOREIGN PATENTS OR APPLICATIONS

| | | | |
|---|---|---|---|
| 297,422 | 6/1954 | Sweden | 34/156 |

*Primary Examiner*—John J. Camby
*Assistant Examiner*—Larry I. Schwartz
*Attorney, Agent, or Firm*—James E. Bryan

[57] ABSTRACT

This invention relates to an improvement in a discharge and draw-off device for driers of material webs including nozzle casings mounted transversely over the path of a web to be dried, and having discharge apertures in said casings for discharging a drying medium and interstices between said casings for drawing-off said medium, the improvement comprising a substantially V-shaped formation of rows of the discharge apertures, whereby a double whirl is produced whose flow spiral increases in the direction toward the draw-off openings.

3 Claims, 5 Drawing Figures

DISCHARGE AND DRAW-OFF DEVICE FOR DRIERS OF MATERIAL WEBS

The present invention relates to a discharge and draw-off device for driers of material webs with air supply lines constructed as nozzle casings or boxes and mounted transversely over a material web, as well as openings directed toward the material web for blowing out the drying medium and drawing it off through the interstices of the individual nozzle casings or boxes mounted at small distances with respect to each other.

This discharge and draw-off device for driers of material webs or material in the form of sheets serves for the effective supply of the drying medium to the material web and for the evacuation thereof, whereby the drying medium absorbs moisture from the material web.

It is known in the art in connection with sheet-type and laminatype materials, such as webs of paper, to draw-off, or remove, the moisture therefrom with the aid of a drying medium. In that case, while the web of material is constantly moved on a conveying device, the drying medium is blown onto the web of material by way of discharge channels, and drawn off, or evacuated, by way of additional channels. Used at that time are so-called pressure chambers in which the drying medium is stored at a slight excess pressure and blown through the openings directed toward the web of material and onto the web. Through separate draw-off openings, the drying medium enriched with moisture is drawn off again.

The discharge openings are provided primarily as round holes or apertures. Also known in the art are arrangements which employ slots as discharge openings.

It is also known in the art to provide for the draw-off process, in proper neighboring draw-off chambers, slots, channels, round holes, or the like. The discharge openings are bores which are directed at a right angle to the web of material so as to direct the drying medium onto the web over a short path.

It further has been proposed, for the purpose of increasing the drying rate, to direct the discharge openings not normal to the web of material but to arrange the direction of flow at different angles in order to increase the degree of efficiency.

An adverse effect of the prior art constructions is that the discharge of the gases is hindered by neighboring discharging gas jets.

For this reason, attempts have been made to further improve the flow or discharge and, as a further suggestion, the discharge openings were uniformly positioned over the entire width of the sheet at respectively identical distances between the individual holes; in other words, also over or across the draw-off channels. While the result thereof was that no individual drying zones were formed along the web of material, which become visible as drying strips or streaks, the kinetic energy of the emerging gases was not completely utilized.

It is the object of the present invention to provide a discharge and draw-off device for this type of web material drier having a specific arrangement of the openings directed toward the web of material, which arrangement largely utilizes the kinetic energy of the discharging gases.

This object is obtained in accordance with the present invention by the arrangement of the discharge openings in a V-shaped sequence with an opened angle in or against the direction of the web of material so that, during the discharge operation, a double whirl is produced whose flow spiral increases in the direction toward the draw-off openings.

In order to make it possible to provide for the formation of the flow spiral, it is proposed, according to another embodiment of the present invention, that the discharge openings, extending respectively from a central opening bore constituting the termination, are positioned so as to be distributed in a uniformly widening pattern in an acute to right angle from one edge of the nozzle casing to the opposite edge thereof. The effect of this design and arrangement is that the drying medium, which uniformly flows out of the nozzle casing is gradually set in rotation so that a flow spiral will be formed along one leg of the row of discharge openings. The same holds true also for the oppositely-positioned row. As a result of the approximately V-shaped configuration of these two rows, enhanced by the neighboring openings, flow spirals will be produced which move oppositely with respect to each other. Accordingly, the full kinetic energy of the drying medium is utilized and an increase in output is attained due to a high turbulence.

The present invention will be illustrated in further detail on the basis of one embodiment thereof and taken with reference to the accompanying drawings, wherein FIG. 1 is a cross-sectional view through several nozzle casings with the directions of flow being indicated by arrows;

Figure 1:
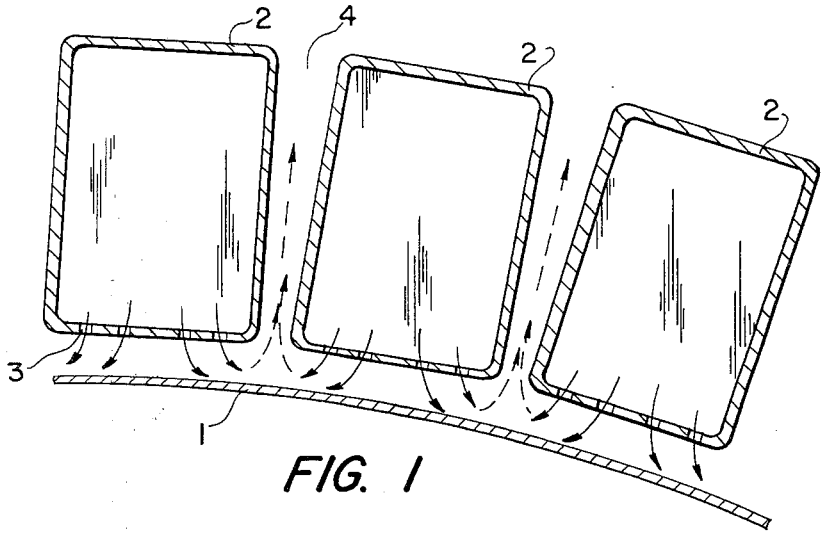

FIG. 1 is a cross-sectional view of several nozzle casings or boxes which are arranged over a web or sheet of material. The material web 1 is passed in known manner over a feeding or conveying device. The nozzle casings or boxes 2 are mounted at a certain distance over the material sheet 1 and have an approximately rectangular cross-section; the drying medium is introduced laterally into the nozzle casings and passed downwardly to the material web through the discharge openings 3. In order to make it possible to remove the drying medium from the surface of the material web, the nozzle casings 2 are not mounted tightly adjacent each other, but rather at certain distances with respect to each other. When a drying cylinder is used, it is possible to mount the nozzle casings 2 laterally parallel and to provide the interstices 4 with a diffuser-like shape. The arrows indicate the direction of flow of the drying medium. The arrows shown in full lines indicate the discharge while the dashed arrows indicate the exhaust of the medium.

Figure 2:
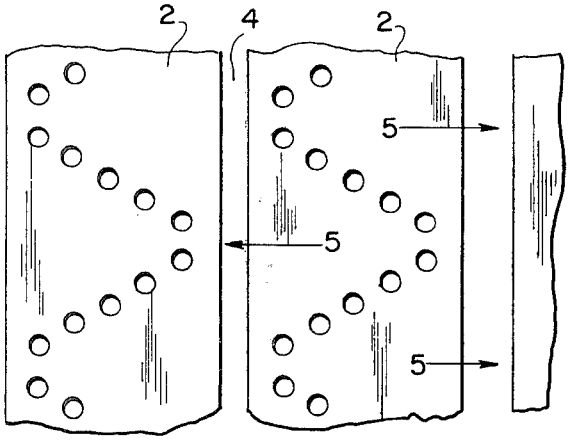
FIG. 2 is a top plan view of the configuration of the discharge openings.

FIG. 2 shows in a top plan view with respect to the nozzle casings 2, the arrangement of the discharge openings 3. In this figure, the discharge openings 3 are positioned in an approximately V-shaped array or sequence in and/or against the direction of movement of the material web. At the left edge of the nozzle casing 2 the individual opening bores 3 begin, and the distance thereof with respect to each other in an adjacent row increases gradually until the maximum is reached at the right edge. This V-shaped configuration is uniformly distributed onto the nozzle casings so that the same angle also will be produced against the operating direction of the material web. In the case of the arrangement of the V-shaped array at an acute angle, it is advantageous to begin with two oppositely-positioned discharge openings 3.

Figure 3:
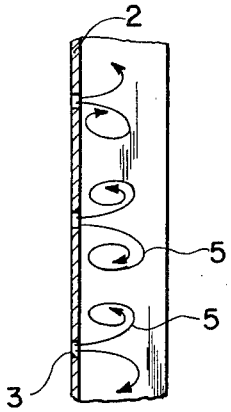
FIG. 3 is a side view of FIG. 2.

FIG. 3 shows in a side view with regard to FIG. 2 the direction of flow from the discharge openings 3 in the nozzle casings 2. Apparent from the arrows 5 is the flow spiral which is produced by the V-shaped arrangement of the discharge openings.

Figure 4:
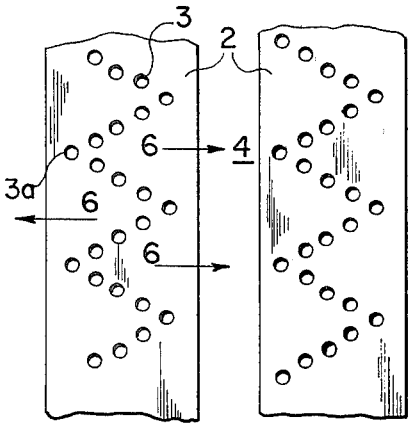
FIG. 4 illustrates the configuration of the discharge openings at a broad angle of the opening array.

In another embodiment of the present invention, FIG. 4 shows the arrangement of the discharge openings in a V-shaped array in an approximately right angle with respect to each other. Tests have shown that it is advantageous, for an arrangement at a wider angle, to begin the first discharge opening 3a with a bore and to thereafter align, or add on, the additional bores in the manner outlined above toward the other end of the nozzle casing.

Figure 5:
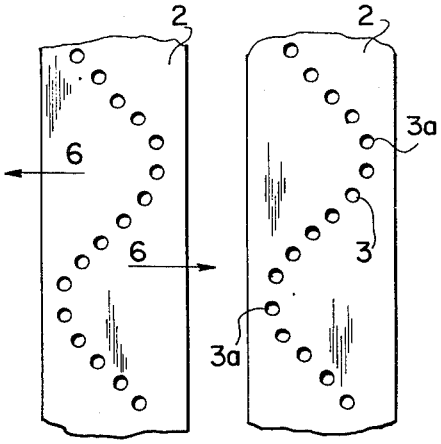
FIG. 5 illustrates a modified embodiment of the present invention.

Lastly illustrated in FIG. 5 is a further possibility of a sequence or array wherein, in contrast to the construction referred to and described hereinabove, the array is made not in a straight line but rather in an approximately sinusoidal arrangement. Here again it is advantageous to begin the first discharge opening 3a at the low point of the sine curve and to arrange the other discharge openings 3 along this line. In all of the figures, the arrows 6 shown therein indicate the direction of the flow spiral. It extends at all times in the same plane of movement of the material sheet, i.e. not laterally with respect thereto, but it is alternately positioned in and/or against the direction of movement.

By virtue of this arrangement, the full kinetic energy is utilized during the discharge of the drying medium and therewith the efficiency of the entire installation is considerably increased.

It will be obvious to those skilled in the art that many modifications may be made within the scope of the present invention without departing from the spirit thereof, and the invention includes all such modifications.

What is claimed is:

1. In a discharge and draw-off device for driers of material webs including nozzle casings mounted transversely over the path of a web to be dried, and having discharge apertures in said casings for discharging a drying medium and interstices between said casings for drawing-off said medium, the improvement comprising a substantially V-shaped formation of rows of the discharge apertures, whereby a double whirl is produced whose flow spiral increases in the direction toward the draw-off openings.

2. A device according to claim 1 in which the discharge apertures extending from an aperture constituting the beginning of a row are positioned in a uniformly widening pattern in an acute to right angle with respect to an adjacent row.

3. A device according to claim 1 in which the discharge apertures are positioned in series along an approximate sine wave curve.

* * * * *